US005593055A

United States Patent [19]

Repp et al.

[11] Patent Number: 5,593,055

[45] Date of Patent: Jan. 14, 1997

[54] SNAP-ON, SCREW-OFF CAP WITH TAMPER-EVIDENT SKIRT AND CONTAINER NECK

[75] Inventors: Richard E. Repp; William R. West, both of San Jose; Daniel Luch, Morgan Hill, all of Calif.

[73] Assignee: Portola Packaging, Inc., San Jose, Calif.

[21] Appl. No.: 213,864

[22] Filed: Mar. 16, 1994

Related U.S. Application Data

[63] Continuation-in-part of Ser. No. 29,177, Mar. 10, 1993, Pat. No. 5,456,376, which is a continuation-in-part of Ser. No. 830,133, Jan. 31, 1992, Pat. No. 5,267,661, which is a continuation-in-part of Ser. No. 772,945, Oct. 8, 1991, Pat. No. 5,213,224, which is a continuation-in-part of Ser. No. 565,638, Aug. 9, 1990, Pat. No. 5,190,178.

[51] Int. Cl.[6] ..... B65D 41/34

[52] U.S. Cl. ..... 215/256; 215/318; 215/320; 215/329; 215/354

[58] Field of Search ..... 215/252, 253, 215/254, 256, 318, 320, 321, 329, 354, 356, 357

[56] References Cited

U.S. PATENT DOCUMENTS

| | | | |
|---|---|---|---|
| 3,181,725 | 5/1965 | Friedl . | |
| 3,885,696 | 5/1975 | Eberhardt . | |
| 3,901,403 | 8/1975 | Menke . | |
| 4,057,160 | 11/1977 | Victor, et al. . | |
| 4,299,330 | 11/1981 | Walter . | |
| 4,399,926 | 8/1983 | Eidels-Dubovoy . | |
| 4,489,843 | 12/1984 | Drozd, Jr. . | |
| 4,494,664 | 1/1985 | Guala . | |
| 4,534,479 | 8/1985 | Conti . | |
| 4,534,480 | 8/1985 | Santostasi et al. . | |
| 4,562,930 | 1/1986 | Lecinski, Jr. et al. . | |
| 4,567,992 | 2/1986 | Davis | 215/222 |
| 4,593,830 | 6/1986 | Bullock | 215/256 |
| 4,609,115 | 9/1986 | Moore et al. . | |
| 4,699,285 | 10/1987 | Perne, et al. . | |
| 4,784,296 | 11/1988 | Bullock | 215/256 X |
| 4,848,613 | 7/1989 | Nofer . | |
| 4,911,316 | 3/1990 | Tackles | 215/256 |
| 5,027,964 | 7/1991 | Banich, Sr. . | |
| 5,147,060 | 9/1992 | Lima et al. . | |
| 5,152,416 | 10/1992 | Cassel . | |
| 5,176,270 | 1/1993 | Battagazzore | 215/252 |
| 5,190,178 | 3/1993 | Luch | 215/256 |
| 5,224,616 | 7/1993 | Crisci | 215/256 |
| 5,285,912 | 2/1994 | Molinaro . | |
| 5,307,946 | 5/1994 | Molinaro | 215/329 |

FOREIGN PATENT DOCUMENTS

| | | |
|---|---|---|
| 2114553 | 8/1983 | United Kingdom . |

*Primary Examiner*—Stephen Cronin

*Attorney, Agent, or Firm*—Julian Caplan, Flehr, Hohbach, Test, Albritton & Herbert

[57] ABSTRACT

A tamper-evident, snap-on, screw-off closure is used with a specially shaped container neck. The neck has at least one first helical thread on a neck stretch portion, and at least one external ratchet tooth on a locking wall portion below the neck stretch. The closure has an upper skirt having at least one second helical thread mating with the first helical thread of the neck and a lower skirt with at least one internal ratchet tooth shaped and positioned to engage the external ratchet tooth when the closure is applied to the neck. The teeth formed on the skirt interior and neck exterior are arranged to provide at least one circumferentially extending stretch of the tamper-evident band where the teeth are not engaged. A line of weakness extending vertically through the disengaged stretch of the tamper-evident band is ruptured when the closure is unscrewed from the neck.

18 Claims, 4 Drawing Sheets

SNAP-ON, SCREW-OFF CAP WITH TAMPER-EVIDENT SKIRT AND CONTAINER NECK

CROSS-REFERENCE TO RELATED APPLICATIONS

This application is a continuation-in-part of U.S. Ser. No. 07/029,177, filed Mar. 10, 1993, now U.S. Pat. No. 5,456,376, which is a continuation-in-part of U.S. Ser. No. 07/830,133, filed Jan. 31, 1992, now U.S. Pat. No. 5,267,661, issued Dec. 7, 1993, which is a continuation-in-part of U.S. Ser. No. 07/772,945, filed Oct. 8, 1991, now U.S. Pat. No. 5,213,224, issued May 25, 1993, which is a continuation-in-part of U.S. Ser. No. 07/565,638, filed Aug. 9, 1990, now U.S. Pat. No. 5,190,178, issued Mar. 2, 1993. The disclosures of the above mentioned applications are hereby incorporated herein by reference.

BACKGROUND OF THE INVENTION

1. Field of the Invention

The present invention relates in general to a tamper-evident container closure and container neck structure in which the closure is applied to the neck with an axial downward force. The closure is removed by unscrewing it from the neck. The tamper-evident skirt of the closure ruptures when the closure is initially removed from the container neck. The absence of the tamper-evident skirt provides visible evidence that the container has been opened and the contents of the container possibly tampered with by a dishonest patron. In the present invention a vertical tear line in the skirt ruptures when one attempts to unscrew the closure, thereby insuring that tamper-evidence is apparent.

2. Description of the Related Art

The snap-on, screw-off structures available in the prior art are of two general types-those having thread engagement as initially applied, and those without initial thread engagement. The no-thread initial engagement system has the major advantages of being simple to manufacture and apply, and achieving good re-seal on reclosure through the thread torque. However, using a liner closure with this system is somewhat difficult and the consumer may be confused by the requirement of twisting the closure relative to the neck after the container is initially opened by a lifting motion. Examples of closure systems having no-thread initial engagement are those taught by U.S. Pat. No. 4,561,553 to Crisci, and U.S. Pat. No. 4,946,055 to Towns et al.

Systems having partial to full thread engagement after the initial application have several advantages over the no-thread system, including the elimination of consumer confusion. However, the initial thread engagement systems often do not offer the manufacturing and application advantages available with the no-thread system. With some systems, the closure must be twisted relative to the container at some point during the application process. An example of such a closure is shown in U.S. Pat. No. 4,625,875 to Carr. Other concepts, such as that taught by Miskin in the European Patent Specification No. 0 118 267 do not require orientation or twisting during application, and accommodate for the inevitable closure height variation after application by employing an extended plug to seal against the inside bore of the container neck.

Both the system taught by Carr and Miskin suffer from the requirement that the tamper evident band must be expanded over a restrictive container bead during the application process. This requirement leads to application difficulties, especially in the Miskin concept where the rotary assist as taught by Carr is not employed. An additional problem common to both the Carr and Miskin concepts is that the lower tamper evident band is joined to the upper closure skirt through bridges requiring mold slides for formation, a feature which greatly increases the cost and complexity of injection molding tooling. Finally, in both the Miskin and Carr concepts the tamper evident band remains on the bottle after initial opening, a feature which thwarts effective container recycling. Leaving the band on the bottle may also lead the consumer to believe that the container has not been previously opened.

Other systems available in the art include screw-on, screw-off structures which also offer the advantages of initial thread engagement and elimination of consumer confusion. An example of this type of closure is shown in U.S. Pat. No. 3,980,195 to Fillmore. The system taught by Fillmore includes a threaded, tamper-evident closure with a removable band. The interior of the removable band is formed with a one-way ratchet, which cooperates with projections formed on the neck to prevent unscrewing of the container. When the closure is initially twisted onto the neck, the ratchet teeth slip over the projections on the neck. The band must be removed prior to opening the container.

The snap-on, screw-off structures have several advantages not found with the closure taught by Fillmore. The application process used with the screw-on, screw-off systems is quite complex since the cap must be turned or rotated relative to the container until the closure is fully seated. The frangible connections between the tamper-evident band and the closure must be sufficiently strong to prevent partial separation when the cap is twisted onto the container, increasing the costs of manufacture. The consumer will also often have difficulty removing the closure as the strong frangible connections must first be fractured to separate the band from the rest of the cap.

This invention provides a snap-on, screw off system with partial or full thread initial engagement by reason of a unique thread design, a unique tamper-evident band and optional means for orienting the closure and container threads to achieve thread registration prior to straight axial application. The present invention offers considerable advantages over prior structures as is evident from the description of the related art and the following description of the invention.

SUMMARY OF INVENTION

The present invention comprises an improved closure or cap and neck finish. The cap skirt and neck are provided with mating threads of such shape that the cap may be applied in a simple downward vertical movement without relative rotation, the cap skirt flexing sufficiently to permit the threads to slip past each other. The interengagement of the threads requires that the closure be unscrewed for removal from the container.

The cap has a tamper-evident tear band frangibly attached to the cap skirt by a plurality of bridges or line of weakness. A plurality of ratchet teeth extend circumferentially around the interior of the tamper-evident band. The neck finish also includes multiple ratchet teeth below the threads on the neck. In one modification of the invention the teeth are localized, with the groups of teeth separated by gaps or interrupted stretches. The teeth on the cap interior cooperatively engage the teeth on the neck exterior to prevent removal of the cap so long as the tamper-evident band is intact. The cap may be unscrewed, fracturing the bridges or line of weakness and separating the tamper-evident band from the cap skirt, to initially open the container. Alternatively, the tamper-evident band may be torn from the cap skirt and the cap easily unscrewed from the neck.

When the cap is unscrewed without first removing the tamper-evident band, the fractured bridges provide evidence that the container has been opened. However, an inattentive consumer may not notice whether the frangible section joining the tamper-evident band to the cap skirt has been fractured. The cap and neck are preferably constructed so that the tamper-evident band splits when the cap is initially removed from the container, providing a more pronounced indication that the container has been opened. Specifically, the teeth on the skirt interior and neck exterior are arranged to provide at least one circumferentially extending stretch of the tamper-evident band where the teeth are not engaged. The tamper-evident band is formed with a vertical line of weakness which is positioned in the disengaged stretch of the tamper-evident band such that when the cap is unscrewed, the line of weakness ruptures splitting the tamper-evident band. Even the inattentive consumer will warned of possible tampering with the contents of the container.

In one modification of the invention, the teeth on the neck are separated by at least one interrupted stretch. The cap is optionally oriented to substantially align the line of weakness with the leading edge of the interrupted stretch on the neck to ensure that the tear line ruptures when the cap is unscrewed. Orienting the cap and container also achieves complete thread engagement and allows the use of lined closures for extra seal security or the reduction in seal plug and closure height. The cap preferably has a downward extending tear tab, while the container has a non-circular cross section or some other variation from a round shape which may be used for orienting the container relative to the cap. However, other means may be used to orient the cap and container.

BRIEF DESCRIPTION OF THE DRAWINGS

The accompanying drawings, which are incorporated in and form a part of this specification, illustrate embodiments of the invention and, together with the description, serve to explain the principles of the invention.

DETAILED DESCRIPTION OF THE PREFERRED EMBODIMENTS

Figure 1:
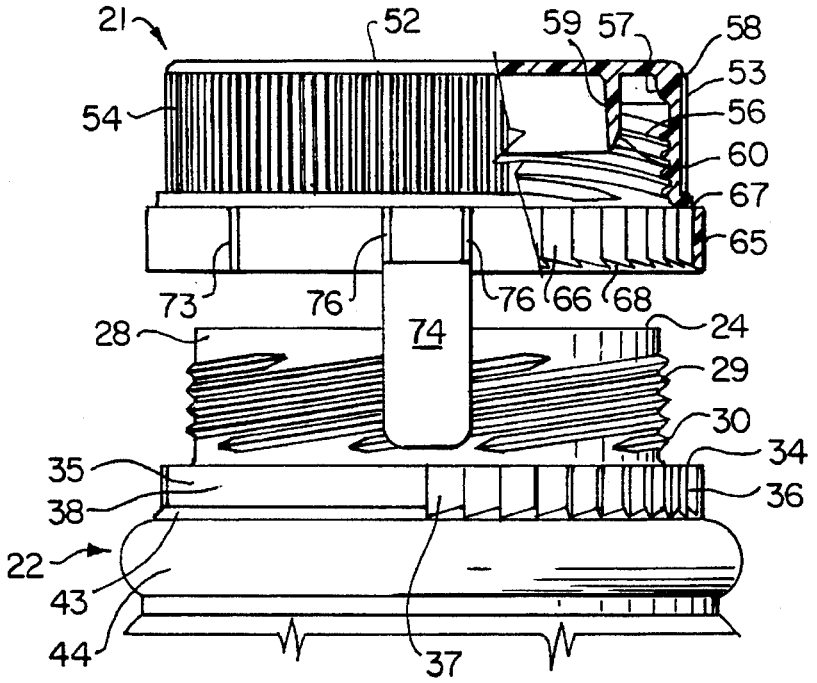
FIG. 1 is a side elevational view of a cap and neck before assembly, the cap being partially broken away in section to reveal internal construction.
Figure 2:
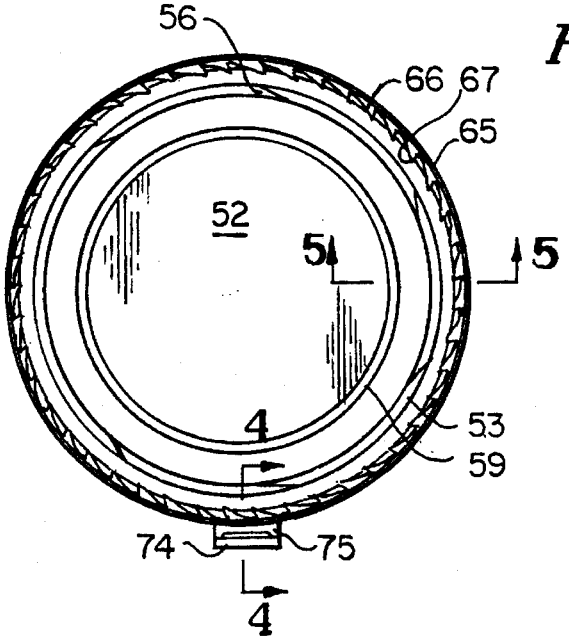
FIG. 2 is a bottom plan view of the cap.
Figure 3:
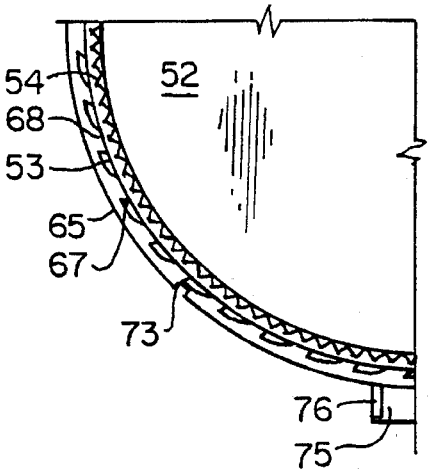
FIG. 3 is a enlarged, fragmentary top plan view of the cap.
Figure 4:
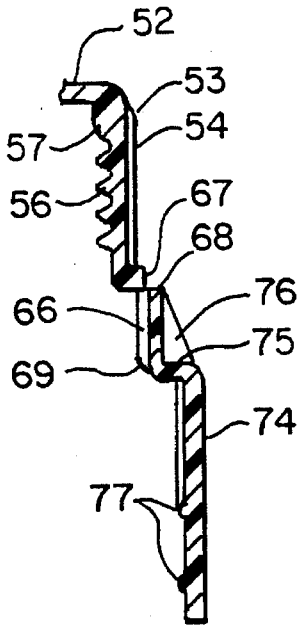
FIGS. 4 and 5 are, respectively, enlarged, fragmentary sectional views taken along lines 4—4 and 5—5 of FIG. 2.
Figure 5:
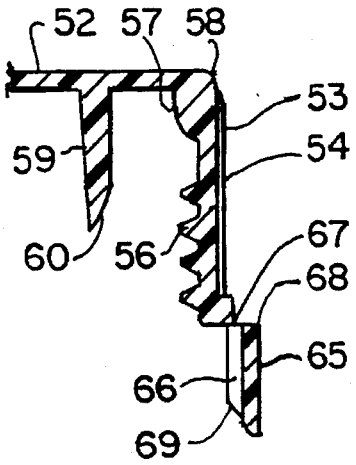
Figure 6:
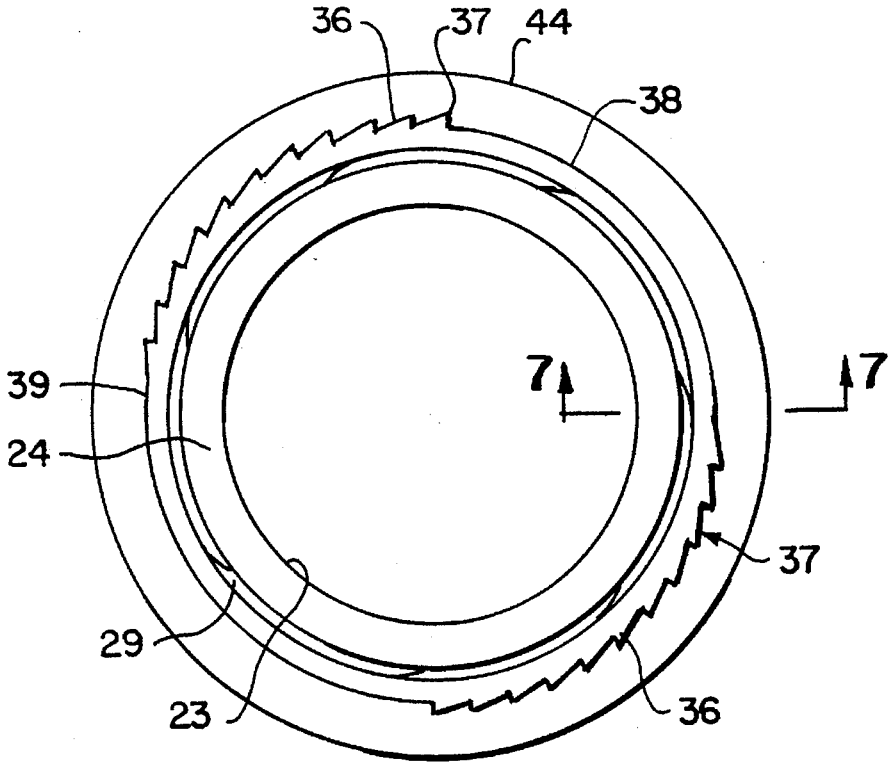
FIG. 6 is a top plan view of the neck.
Figure 7:
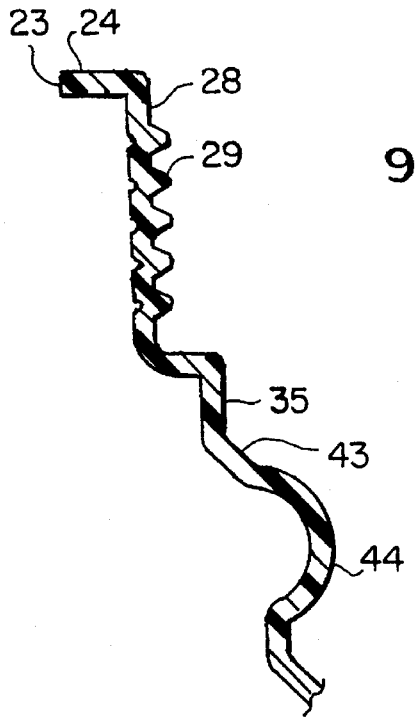
FIG. 7 is an enlarged, fragmentary sectional view taken along line 7—7 of FIG. 6.
Figure 8:
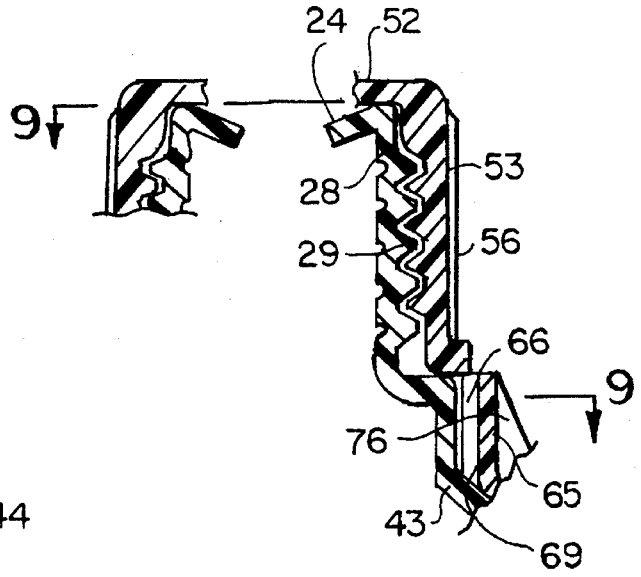
FIG. 8 is an enlarged, fragmentary sectional view through an assembled cap and neck taken in the position of line 4—4 of FIG. 2 and line 7—7 of FIG. 6.
Figure 9:
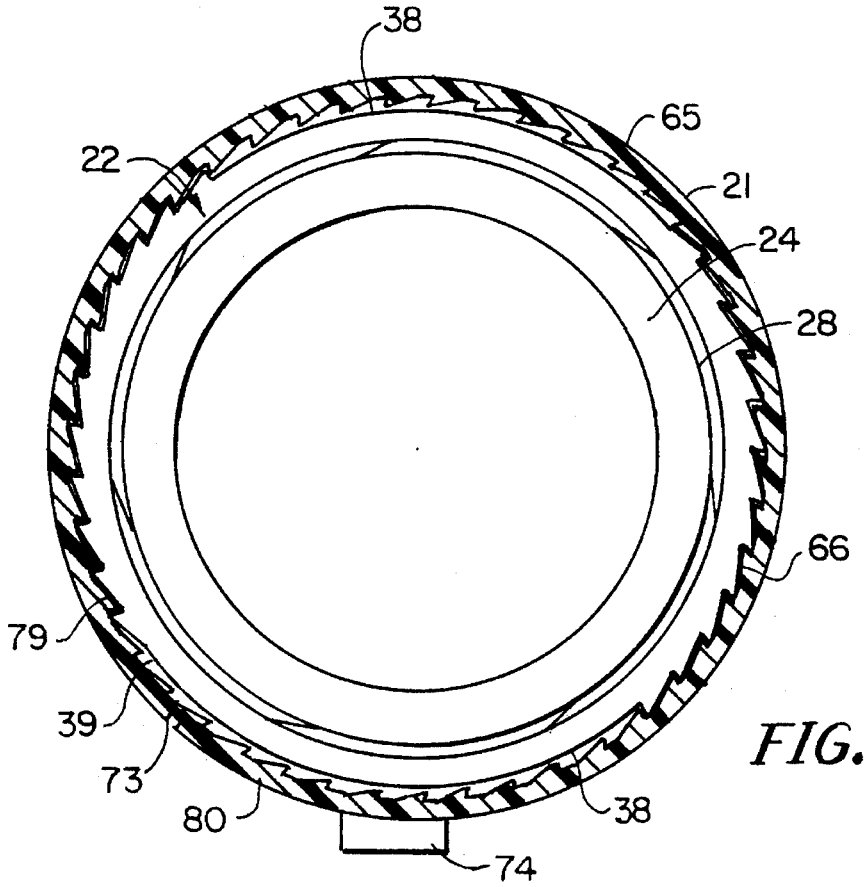
FIG. 9 is a enlarged, sectional view taken substantially along line 9—9 of FIG. 8.

Reference will now be made in detail to the preferred embodiments of the invention, examples of which are illustrated in the accompanying drawings. While the invention will be described in conjunction with the preferred embodiments, it will be understood that they are not intended to limit the invention to those embodiments. On the contrary, the invention is intended to cover alternatives, modifications and equivalents, which may be included within the spirit and scope of the invention as defined by the appended claims.

Closure 21, hereinafter described in detail, is used with a container neck 22. The closure 21 and the neck 22 are subject to some variation, but preferably are formed for direct, axial application without relative rotation of the closure and the container. The interior of the neck 22 forms no part of the present invention. With a blow-molded bottle finish, the interior contour tends to follow that of the neck exterior. However, it will be understood that other types of bottles may be used, with the internal shape of the neck varying from that of the exterior.

Neck 22 has a central opening 23, a lip 24 surrounding the opening 23 and a vertical stretch 28 depending from the lip. It should be understood that the term "lip" used herein refers to the edge of the neck around the opening, which may be in the form of an annular rim, a flange, or any other shape known in the art. In the embodiments shown in the Figures, lip 24 is in the shape of a downward/outward slanted lip flange. Helical engagement means, such as threads 29, extend outward of stretch 28. The shape of the threads 29 permits the threads on the interior of the cap to slip past and interengage the threads 29 of the neck. Preferably, the thread apex 30 is made with as large a radius as possible, allowing direct axial application of cap 21 while requiting that the cap be unscrewed and not pulled from the neck. The multilead neck finish has seven threads 29 with each thread extending 215° of the neck circumference and a linear thread density of approximately 17.5 threads per inch. It is to be understood that the length of the threads, number of leads, and thread density may be subject to considerable variation. The threads may continuous or interrupted, or may be replaced with other engagement means such as a cooperatively shaped groove.

The vertical stretch 28 terminates in an outward extending shoulder 34. A locking wall portion 35 below the vertical stretch 28 has a plurality of external ratchet teeth 36 projecting from the locking wall. The ratchet teeth 36 are shaped to interengage the internal ratchet teeth formed on the cap, preventing twisting of the cap relative to the neck. As shown particularly in FIG. 6, the neck finish has two diametrically opposed groups 37 of eleven teeth each which are separated by diametrically opposed interrupted stretches 38 which extend approximately 90° of the circumference of the locking wall portion. Forming the neck 22 with a symmetrical finish as in the modification depicted in FIGS. 1–9 is preferred when the container is oriented relative to the cap during the capping process as the symmetrical finish provides two suitable positions in which the container may be oriented. However, it is to be understood that the number and arrangement of ratchet teeth 36 and interrupted portions 38 may vary as desired. The teeth 36 and interrupted stretch 38 provide tamper-evidencing means which, together with the tamper-evidencing means of the cap, ensure there is visible evidence of the initial opening of the container.

The locking wall 35 terminates in an slanted stretch 43 which slants downward/outward at an angle of approximately 45°. Below the slanted stretch 43 is an outward-extending convex stretch or "bumper ring" 44 which facilitates gripping the container during the filling and loading process. The lower edge of the convex stretch 44 merges with the container.

A cap 21 for use with neck structure 22 is illustrated in FIGS. 1–5. The cap has a top 52 from the periphery of which depends a downward extending upper skirt 53. The top as illustrated comprises a generally flat top disk; however, other configurations such as a dome shape may be substituted. The exterior of upper skirt portion 53 has spaced vertical ribs 54 to enable the user to grip the cap.

Helical engagement means, such as threads 56, are formed on the interior of the skirt 53. The threads are selected to mate with threads 29 of neck 22, with the shape of threads 29 and 56 allowing the threads to slip past one another and then interengage. The helical engagement means may be provided by continuous threads as shown, interrupted threads or other engagement means. Threads 56 are multilead, here shown seven in number, with each thread extending approximately 180° around the circumference of the cap. The cap tends to rest horizontally on neck 22 when deposited on the neck by conventional capping machines since the leads of threads 56 are evenly distributed around the circumference of the cap, facilitating the application of the cap onto the neck with a downward axial force. The linear density of the threads 56 in the embodiment illustrated in FIGS. 1–9 is approximately 17.5 threads per inch. However, it is to be understood that the length of the threads, number of leads, and thread density may be subject to considerable variation.

In order for the closure and container threads to effectively slip past each other during direct axial application, the threads must be finer than those of a threaded closure applied by conventional rotary application. As threads become finer, a greater amount of total thread engagement is often necessary to prevent excessive forward stripping on reapplication. A total thread engagement of approximately 1190° is satisfactory for the embodiment illustrated in FIGS. 1–9 where the multilead threads 56 are formed with a thread density of 17.5 threads per inch, although it is to be understood that the total thread engagement may be increased or decreased as desired. If the thread density is decreased, the total thread engagement required to prevent excessive forward stripping would be less than with the embodiment of FIGS. 1–9. For example, 400° of total thread engagement would be satisfactory for a linear thread density of twelve turns per inch.

An inward extending portion 57 projects inward from the interior of the upper skin 53 below the underside of the top 52 to define the minimum interior circumference of the cap. Preferably, the minimum interior circumference of the cap is less than the exterior circumference of the neck stretch 28 to form a tight fit between the upper skirt 53 and the neck stretch 28. When the cap is applied, the inward extending portion 57 contacts the upper edge of the neck stretch 28 and biases the upper edge 58 of the upper skirt outward, stretching the top 52 of the cap and forming a tight fit between the upper skirt 53 and the neck stretch 28.

A plug or inner skirt 59 depends from the underside of the top 52. The plug 59 is spaced inward of the upper skirt 53 to fit inside the neck opening 23. The outer bottom edge of the plug 59 is preferably formed with a bevel 60 to facilitate seating of the cap 21 on the neck. The plug 59 is pulled against the interior edge of the lip 24 as the cap 21 seats on the neck and the neck stretch 28 biases the upper edge 58 of the outer skirt outward. With a blow molded finish, neck opening 23 is formed using a blow mold plug which provides the interior edge of the lip 24 with a seamless surface. Since the exterior edge of the plug is also seamless, pulling the plug against the interior edge of the lip forms a substantially liquid impervious seal between the cap 21 and the neck 22.

The cooperation between inward extending portion 57, the plug 59 and the interior edge of lip 24 provides the closure system with a substantially leak tight seal. The seal between the plug exterior and the lip is of particular interest when the neck has a blow molded finish. However, it should be understood that various other sealing means may be used to seal the container.

A lower skirt or tamper-evident band 65 below the upper skirt 53 has a plurality of internal ratchet teeth 66 projecting inward from the interior of the lower skirt 65. The lower skirt is attached to the lower edge of the upper skirt by frangible connections or bridges 67 extending between the upper skirt and the upper edge 68 of the teeth 66. Depending upon the strength and number of frangible bridges 67 incorporated in the cap, the bridges may prevent removal of the cap without separating the lower skirt 67 from the upper skirt 53, or the bridges may rupture when a consumer attempts to initially remove the closure 21 from the neck 22. The teeth 66 have beveled tips 69 which engage the upper edges of the teeth 36 and urge the teeth 66 into interengagement with teeth 36 when the cap is applied to the neck. The beveled tips 69 are positioned opposite the slanted stretch 43 below the locking wall 35 when the cap is seated on the neck. In the embodiment depicted in FIGS. 1–9, the beveled tips are inclined downward-outward at an angle of about 45°, although the slant of the tips 69 may be increased or decreased as desired.

The teeth 66 on the interior of the lower skirt 65 are shaped and positioned to engage teeth 36 on locking wall portion 35 when the cap 21 is seated on the neck. The interengagement between the teeth 36 and 66 prevents removal of the cap 21 so long as the tamper-evident band is intact. In the embodiment illustrated in FIGS. 1–9, the entire circumference of the band 65 is formed with teeth 66. It is to be understood that in other modifications of the invention the interior of the lower skirt may have one or more interrupted stretches without teeth 66.

The lower skirt 65 preferably has a vertically extending line of weakness 73 which ruptures when the container is initially opened, splitting the lower skirt to provide a visible indication that the container has been opened. The weakened line 73 may be provided by a continuous thin tear line extending through the lower skirt, as shown in FIG. 1, or the weakened line 73 may alternatively be formed using other frangible means known in the art. In addition to protecting the consumer from a dishonest patron, the line of weakness facilitates separation of the lower skirt from the upper skirt and eliminates the dangers an intact band may present to wildlife.

The cap 21 may be very forcefully removed from the neck 22 without first removing the lower skirt 65 by unscrewing the cap, thereby causing the bridges 67 to fracture and the lower skirt to be separated from the upper skirt 53. In such event, in the prior art, lower skirt 65 is not torn. Hence, if the cap is screwed back on the neck, the fact that bridges 67 have been fractured may not be readily apparent. Alternatively, the lower skirt 65 may be removed from the cap 21 before the cap is twisted open. A tear tab 74 extends downwardly from an outward extending shoulder 75 at the lower edge of the tamper-evident band 65. The tear tab provides means for removing the lower skirt and may also be used to orient cap 21 relative to the container prior to application. The consumer may grasp the tear tab 74 and pull the band 65 from the container, rupturing the weakened line 73 and circumferentially fracturing bridges 67. Once the lower skirt is removed, the consumer may unscrew the cap 21 from the neck 22.

Vertically extending reinforcement fins 76 are formed between the shoulder 75 and the lower skirt 65 to provide further protection against tampering with the container. The fins 76, which coincide with the edges of the tab 74, ensure that bridges 67 will rupture and provide evidence of tampering if an attempt is made to pry the lower skirt upward. The fins 76 also reinforce the tear tab so that when the tab is lifted away from the container, the weakened line 73 fractures allowing efficient removal of the lower skirt from the cap 21. The tear tab 74 is further reinforced by ribs 77 formed on the underside of the tab. The ribs 77 also improve the ability of a user to grip the tab and raise the lower end of the tab from the neck exterior so that a user may slip a fingernail below the tab and easily lift the tab from the neck.

The teeth 36 and 66 formed on the skirt interior and neck exterior are arranged to provide at least one circumferentially extending stretch of the tamper-evident band where the teeth are not engaged. The line of weakness 73 extends vertically through the disengaged stretch of the lower skirt to ensure that the lower skirt splits when the cap 21 is initially unscrewed. In the embodiment depicted in FIGS. 1–9, the cap is preferably oriented with the weakened line 73 opposite the leading edge 39 of one of the interrupted stretches 38 on the neck so that the weakened line is immediately adjacent the engaged portion 79 of the band. Moving in the direction of arrow A, in which the cap is unscrewed, the engaged portion 79 precedes the disengaged portion 80 of the band. Positioning the weakened line 73 near the engaged portion 79 increases the likelihood that the line of weakness will rupture when the cap is unscrewed.

As the cap is twisted in the direction of arrow A, movement of the engaged portion 79 of the band is restrained by the interengagement between the teeth 36 and 66. The disengaged portion 80 of the lower skirt opposite the interrupted stretch 38 is biased in the direction of arrow A when the cap is unscrewed since the teeth 66 in this area do not engage any teeth 36 on the neck. Biasing the disengaged portion 80 of the lower skirt in the direction of arrow A while the engaged portion 79 is held in place ruptures the weakened line 73, splitting the lower skirt.

While the line of weakness 73 is preferably aligned with the leading edge 39, the actual position of the weakened line in the interrupted stretch 38 may vary. With weakened line 73 aligned with the interrupted portion 38 of the neck, the lower skirt 65 will split even if the consumer chooses to initially open the container by unscrewing the cap without first removing the tamper-evident band. Removing the lower skirt from the container provides a more pronounced warning than the presence of fractured bridges as an inattentive consumer may fail to notice the fractured bridges and mistakenly believe that the tamper-evident band is intact. Thus, the combination of weakened line 73 and disengaged portion 80 provides an effective tamper-evidencing means for warning the consumer of possible tampering with the container.

Figure 10:
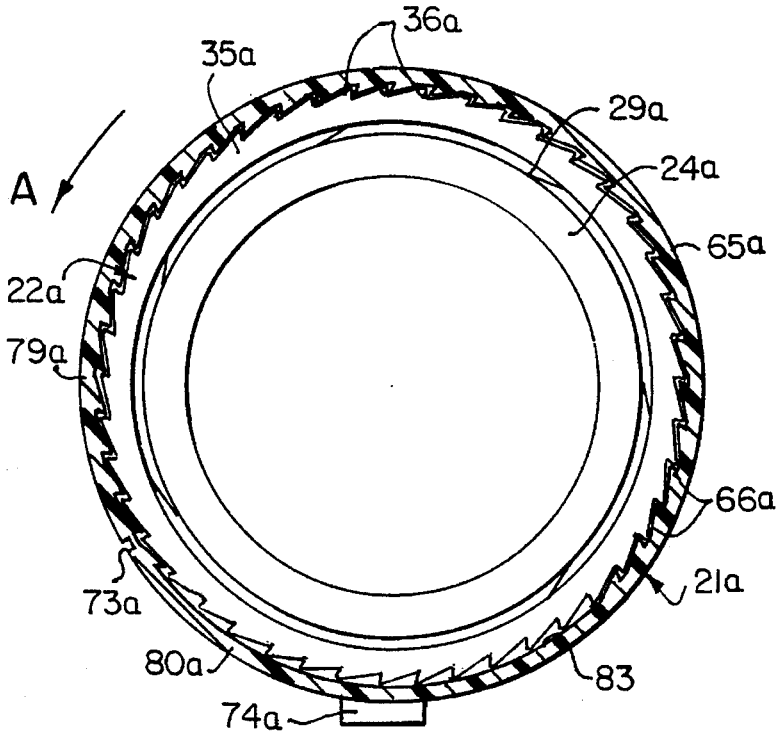
FIG. 10 is a view similar to FIG. 9 of a modified cap and neck.

Turning to FIG. 10, a cap **21*a* having a lower skirt 65*a* with a plurality of teeth 66*a* separated by an interrupted stretch 83 is depicted. A vertically extending weakened line 73*a* is formed in the interrupted stretch 83 of the lower skirt. The cap 21*a* need not be oriented relative to the container since the disengaged portion 80*a* of the band is formed without teeth. Neck 22*a* has teeth 36*a* formed on the entire circumference of the locking wall portion 35*a*, but may also have one or more interrupted stretches in other modifications. Movement of the engaged portion 79*a* of the lower skirt is restrained by the interengagement of teeth 36*a* and 66*a*, while the disengaged portion 80*a* is biased in the direction of arrow A when the cap 21*a* is unscrewed. The movement of the disengaged portion 80*a* while the interengaged portion 79*a* is held stationary causes the weakened line 73*a*** to fracture, splitting the lower skirt and removing the lower skirt from the container.

Figure 11:
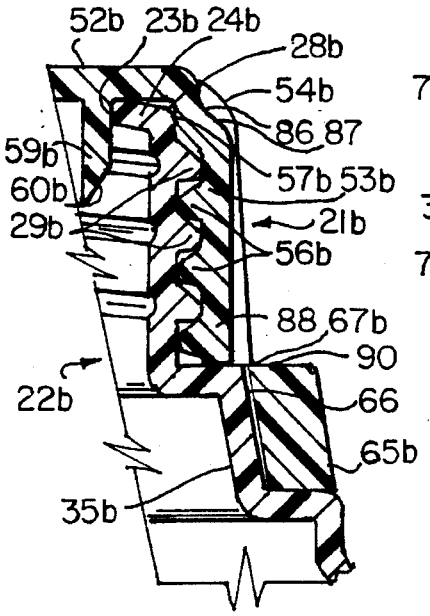
FIG. 11 is a view similar to FIG. 8 of another modification of a cap and neck.
Figure 12:
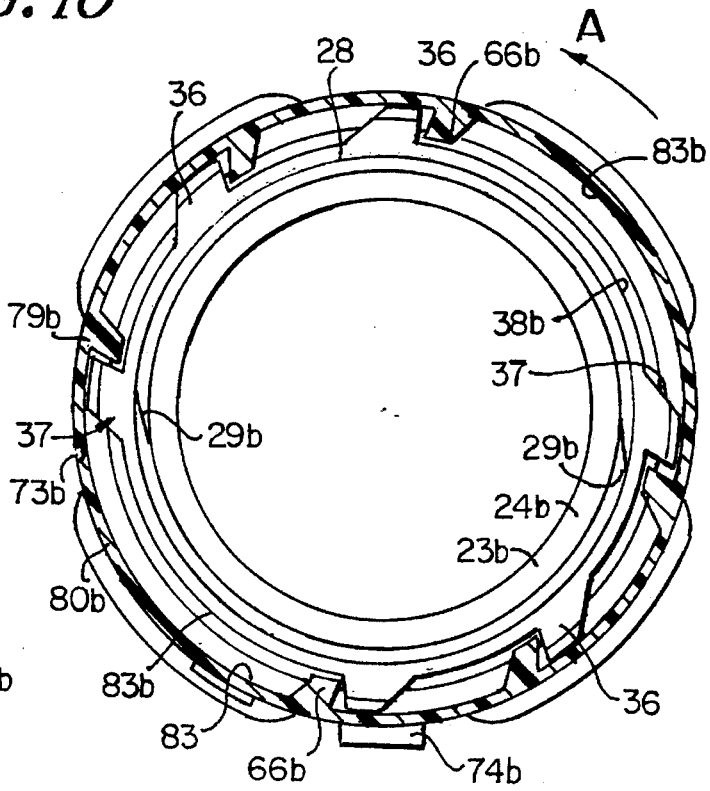
FIG. 12 is a view similar to FIG. 9 of the modification of FIG. 11.

FIGS. 11 and 12 illustrate another modification of a cap **21*b* and a neck 22*b*. The neck 22*b* is formed with two continuous threads 29*b* which extend helically around the exterior circumference of the neck. Two groups 37*b* of three teeth 36*b* project outward from the locking wall portion 35*b* and are separated by interrupted stretches 38*b*. In the embodiment depicted in FIGS. 11 and 12, the teeth 36*b* are spaced with each group 37*b* of teeth extending approximately 90° around the circumference of the neck. However, the number of teeth may be increased or decreased and the grouping of the teeth may be modified. The locking wall 35*b* and the outer surface of teeth 36*b*** slant downward/outward at an angle of approximately 10°.

Cap **21*b* has an upper skirt 53*b* including an upper stretch 86, a downward/outward slanted stretch 87 and a lower stretch 88. An internal shoulder formed at the intersection of upper stretch 86 and slanted stretch 87 defines the inward extending portion 57*b*. When the cap 21*b* is seated on the neck 22*b*, the inward extending portion 57*b* engages the upper edge of the neck stretch 28*b* and biases the upper stretch 86 outward, pulling the plug 59*b* against the inner edge of the lip 24*b*. Two continuous threads 56*b*** extend helically around the interior of the upper skirt.

A lower skirt **65*b* with an inward extending shoulder 90 is frangibly joined to the upper skirt 53*b* by a plurality of bridges 67*b*. The shoulder 90 substantially prevents the accumulation of foreign particles between the lower skirt 65*b* and locking wall 35*b* of the neck. As shown in FIG. 11, the lower edges of ribs 54*b* on the exterior of the upper skirt constitute the bridges 67*b*. The interior of the lower skirt is formed with a plurality of teeth 66*b* separated by interrupted stretches 83*b*. The teeth 66*b* are shaped and positioned to engage the teeth 36*b* on the exterior of the locking wall 35*b***.

The lower skirt **65*b* further includes a vertically extending line of weakness 73*b* aligned with the interrupted stretch 38*b* when the cap 21*b* is seated on the neck 22*b*. When the cap 21*b* is twisted in the direction of arrow A, the engaged portion 79*b* is held in place by the interengagement of teeth 36*b* and 66*b* while the disengaged portion 80*b* is urged in the direction of arrow A. The weakened line 73*b* ruptures, splitting the lower skirt. Even if the consumer does not tear away the lower skirt 65*b* before the cap 21** is unscrewed, the weakened line ensures that the lower skirt is removed from the container when the cap is initially unscrewed. The absence of the lower skirt provides a visible warning to the consumer that the container has been previously opened and the contents potentially tampered with by a dishonest patron.

Except as set forth above, the modifications of FIGS. 10 and 11–12 resemble those of the preceding modifications and the same reference numerals followed by the subscripts a and b, respectively, are used to designate corresponding parts.

PREFERRED OPERATION

After the container has been filled, it is transported through a capping machine. The structure of capping machines is well known in the bottling art. As is well understood in the art, and in a manner similar to that whereby push-on, pull-off caps are applied, caps 21 are fed one at a time out of a bowl in the capping machine along a chute. One type of chute is formed with a space between parallel rails, with tear tab 72 orienting the caps for uniform discharge in a pre-determined orientation relative to the containers passing therebelow by fitting into the space between the rails. Preferably each container has a non-circular cross section, some other variation from a round shape, or some other orientation means which permits the container to be oriented relative to cap 21. The container travels along a conveyer belt below the capping machine. Guide rails adjacent the conveyor belt directionally align the non-circular cross section of the container relative to the tear tab 72 of the cap to align the weakened line 73 with the interrupted stretch 38. If the weakened line 73 is not aligned with one of the interrupted stretches, the container may be automatically or manually rotated to properly position the cap relative to the container. Thus, in this present embodiment, the cap 21 and neck 22 may be conveniently oriented relative to one another by the conventional capping machine and conveyor belt system. Because of the relative orientation, the weakened line is positioned near the leading edge 39 of the interrupted stretch 38. Threads 29 and 56 are in vertical alignment, ensuring full thread engagement and complete interengagement of the teeth 36 and 66. In other embodiments, the teeth 36 and 66 need not be vertically aligned.

An axially downward force is applied to the cap, pushing the cap onto the neck without externally imposed relative rotation of the cap and container. Threads 56 slip over threads 29, the slanted surfaces of the neck threads facilitating such movement. The cap is sufficiently resilient so that it expands outward to permit the threads to slip. In a preferred form of the present invention, the weakened line 73 is positioned opposite the interrupted stretch 38. Teeth 66 fall behind and engage teeth 36 as the cap seats on the neck. After the cap has been fully seated on neck 22, it may not be removed without providing evidence of tampering. The interengagement between teeth 36 and 66 prevent unscrewing of the cap from the container, while the interengagement between the threads prevents the lifting of cap 21 off neck 22.

As is apparent from the foregoing discussion, the present invention provides a tamper-evident closure system for a container. The closure has a tamper-evident skirt a portion of which splits on removal of the cap even if the cap is unscrewed without first removing the tamper-evident skirt. Removing the tamper-evident skirt from the container provides a more pronounced indication that the container have been opened and possibly tampered with by a dishonest patron. Since a consumer may fail to notice that the bridges joining the tamper-evident skirt to the cap has been fractured, splitting the tamper-evident skirt when the closure is initially removed ensures that the consumer will be warned that the container has been previously opened.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the Claims appended hereto and their equivalents.

What is claimed is:

1. In combination, a container having a neck and a container closure, said neck having an upper opening, a lip surrounding said opening, a downward extending neck stretch below said lip, said neck stretch having an exterior, at least one first helical engagement means formed on said exterior of said neck stretch, a locking wall portion below said neck stretch, a plurality of first teeth on said locking wall portion, said closure having a top, a downward extending upper skirt depending from said top adapted to fit over said neck stretch, said upper skirt having an interior, at least one second helical engagement means formed on said interior of said upper skirt shaped to engage said at least one first helical engagement means, a lower skirt below said upper skirt, frangible means frangibly joining said lower skirt and said upper skirt together, a line of weakness extending through said lower skirt, a plurality of second teeth on said lower skirt interengaging said first teeth upon direct, axial application of said closure to said neck to prevent unscrewing of said closure in a first rotational direction relative to said neck without breaking said frangible means, said at least one first and second helical engagement means being shaped to slip over each other and then to interengage upon direct axial downward movement of said closure on said neck without relative rotation by external means of said closure and said neck, said lower skirt being configured to rupture substantially along said line of weakness before said lower skirt is completely separated from said upper skirt, said lower skirt having a circumferentially extending engaged portion defined by the interengagement of selected ones of said first teeth and selected ones of said second teeth and a disengaged portion disengaged from said locking wall portion, said engaged portion preceding said disengaged portion in said first rotational direction, said selected ones of said first teeth and said selected ones of said second teeth preventing movement of said engaged portion of said lower skirt relative to said locking wall portion, said line of weakness being positioned in said disengaged stretch at a position relative to said engaged portion to produce the rupturing of said lower skirt when said closure is rotated in said first rotational direction, whereby said lower skirt is split while said lower skirt is at least partially attached to said upper skirt when said closure is unscrewed from said neck.

2. The combination of claim 1 in which said line of weakness extends through said disengaged portion of said lower skirt vicinal said engaged portion.

3. The combination of claim 1, and further comprising orientation means on said closure to orient said closure relative to said container to align said line of weakness with said disengaged portion of said band.

4. The combination of claim 1 in which said lower skirt has at least one interrupted stretch separating adjacent ones of said second teeth, said line of weakness being positioned in said interrupted stretch.

5. The combination of claim 1 in which said line of weakness comprises a continuous tear line extending through said lower skirt.

6. The combination of claim 1 in which said closure further includes means for orienting said closure relative to said container to position said line of weakness at said position of said disengaged portion, said orientation means comprising a tear tab joined to said lower skirt.

7. The combination of claim 1 in which said closure has an inner plug depending from an underside of said top and said upper skirt has an inward extending portion projecting inward from said interior of said upper skirt, said inward extending portion engaging said exterior of said neck stretch portion to form a tight fit between said inward extending portion and said exterior of said neck stretch to bias said plug into sealing engagement with said lip.

8. The combination of claim 1 in which said first helical engagement means and said second helical engagement means are multilead threads.

9. The combination of claim 1 in which said locking wall portion has at least one interrupted stretch between adjacent ones of said first teeth, and in which said line of weakness is positioned opposite said interrupted stretch.

10. The combination of claim 9 in which said interrupted stretch has a leading edge, said line of weakness being substantially aligned with said leading edge of said interrupted stretch.

11. The combination of claim 9, and further comprising orientation means on said closure to orient said closure relative to said neck whereby direct axial downward movement of said closure on said neck causes said line of weakness to be positioned opposite said interrupted stretch.

12. The combination of claim 9 in which said interrupted stretch extends approximately 90° of the circumference of said locking wall portion.

13. In combination, a container having a neck and a container closure, said neck having an upper opening, a lip surrounding said opening, a downward extending neck stretch below said lip, said neck stretch having an exterior, at least one first helical engagement means formed on said exterior of said neck stretch, a locking wall portion below said neck stretch, a plurality of first teeth on said locking wail portion, at least one interrupted stretch separating adjacent ones of said first teeth, said closure having a top, a downward extending upper skirt depending from said top adapted to fit over said neck stretch, said upper skirt having an interior, at least one second helical engagement means formed on said interior of said upper skirt shaped to engage said at least one first helical engagement means, a lower skirt below said upper skirt, frangible means frangibly joining said lower skirt and said upper skirt together, a line of weakness extending through said lower skirt, a plurality of second teeth on said lower skirt interengaging said first teeth to prevent unscrewing of said closure in a first rotational direction relative to said neck without breaking said frangible means, said at least one first and second helical engagement means being shaped to slip over each other and then to interengage upon direct axial downward movement of said closure on said neck without relative rotation by external means of said closure and said neck, said lower skirt being configured to rupture substantially along said line of weakness before said lower skirt is completely separated from said upper skirt, said lower skirt having a circumferentially extending engaged portion defined by the interengagement of selected ones of said first teeth and selected ones of said second teeth and a disengaged portion disengaged from said locking wall portion, said selected ones of said first teeth and said selected ones of said second teeth preventing movement of said engaged portion of said lower skirt relative to said locking wall portion, said engaged portion preceding said disengaged portion in said first rotational direction, said line of weakness being positioned in said disengaged stretch at a position relative to said engaged portion to produce the rupturing of said lower skirt when said closure is rotated in said first rotational direction, whereby said lower skirt is split before said lower skirt is completely separated from said upper skirt when said closure is unscrewed from said neck, and orientation means on said closure for orienting said closure relative to said neck to position said line of weakness at said position of said disengaged stretch.

14. The combination of claim 13 in which said line of weakness comprises a continuous tear line extending through said lower skirt.

15. The combination of claim 13 in which said line of weakness in said lower skirt is positioned opposite said interrupted stretch of said locking wall portion.

16. The combination of claim 15 in which said interrupted stretch has a leading edge, said line of weakness being vicinal said leading edge of said interrupted stretch.

17. The combination of claim 15 in which said interrupted stretch extends approximately 90° of the circumference of said locking wall portion.

18. The combination of claim 15 in which one of said selected ones of said second teeth engages one of said first teeth positioned adjacent said interrupted stretch of said locking wall portion.

* * * * *